US006961434B2

(12) United States Patent
Silverman

(10) Patent No.: US 6,961,434 B2
(45) Date of Patent: Nov. 1, 2005

(54) SUBMERSIBLE HEADPHONES

(75) Inventor: Martin S. Silverman, Camarillo, CA (US)

(73) Assignee: DeNovo Research, LLC, Camarillo, CA (US)

( * ) Notice: Subject to any disclaimer, the term of this patent is extended or adjusted under 35 U.S.C. 154(b) by 312 days.

(21) Appl. No.: 10/183,915

(22) Filed: Jun. 26, 2002

(65) Prior Publication Data

US 2002/0196948 A1 Dec. 26, 2002

Related U.S. Application Data

(60) Provisional application No. 60/301,311, filed on Jun. 26, 2001.

(51) Int. Cl.[7] ..... H04R 1/10; H04R 25/00
(52) U.S. Cl. ..... 381/74; 381/370
(58) Field of Search ..... 381/74, 189, 370

(56) References Cited

U.S. PATENT DOCUMENTS 4,456,797 A * 6/1984 Olsen ..... 381/311
4,584,718 A * 4/1986 Fuller ..... 455/351
4,683,587 A * 7/1987 Silverman ..... 381/311
5,488,961 A * 2/1996 Adams ..... 128/864
5,600,730 A * 2/1997 Kenning et al. ..... 381/77
5,881,729 A * 3/1999 Castillo ..... 128/864

* cited by examiner

*Primary Examiner*—Laura A. Grier
(74) *Attorney, Agent, or Firm*—Bruce A. Jagger

(57) ABSTRACT

Submersible headphones comprising an acoustic circuit in which the electro-acoustic transducer is separated from the open proximal end of the circuit by a length of small hollow tube, and the volume of air in the tube is at least equal to the volume of air in the transducer itself. When the headphones are accidentally dislodged from the ear at some depth below the surface of a body of water, the proportioning of the volume of the air in the tube so that it at least equals the volume of air in the transducer prevents water from traveling down the tube into contact with the transducer. The tube is constructed of hydrophobic material, which tends to prevent water from entering the small diameter tube at atmospheric pressure. Transducers that are suitable for use include piezo-electric transducers and bipolar armature transducers.

5 Claims, 2 Drawing Sheets

SUBMERSIBLE HEADPHONES

RELATED APPLICATIONS

This application claims the benefit of Provisional Ser. No. 60/301,311, filed Jun. 26, 2001.

BACKGROUND OF THE INVENTION

1. Field of the Invention

The invention relates in general to waterproof audio systems, and, in particular, to headphones for such systems. The system is submersible and is particularly well suited for use while swimming or snorkeling.

2. Description of the Prior Art

Waterproof cassette players and associated headphones had been previously proposed. See, for example, Silverman U.S. Pat. No. 4,683,587. Silverman describes a submersible personal stereo. Silverman's disclosed system includes an electro-acoustical transducer coupled to a small internal diameter acoustic transmissive tube. The tubing is hydrophilic and of small enough diameter to prevent water from entering. The speaker is a dynamic speaker. This system tended to take in water when accidentally dislodged from the ear at depths of several feet under water.

The use of hydrophobic materials in a membrane of an ear plug to block the passage of water up to a predetermined pressure while permitting the passage of air and sound is proposed by Adams U.S. Pat. No. 5,488,961.

The use of a single piezoelectric speaker with a plurality of acoustic leads to separate ear pieces is disclosed by Kenning et al. U.S. Pat. No. 5,600,730. The proposed arrangement leaves the system vulnerable to the influx of water because water entering one acoustic lead displaces the air out through the other lead. This is a serious drawback to the use of the proposed structure.

Bipolar armature transducers have been widely used in hearing aids, and their design is well known to those skilled in the art.

These and other difficulties of the prior art have been overcome according to the present invention.

BRIEF SUMMARY OF THE INVENTION

A preferred embodiment of the submersible headphones according to the present invention comprises an acoustic circuit in which the transducer is separated from the open proximal end of the circuit by a small hollow tube, and the volume of air in the tube is at least equal to the volume of air in the transducer itself.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of submersible acoustic devices. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
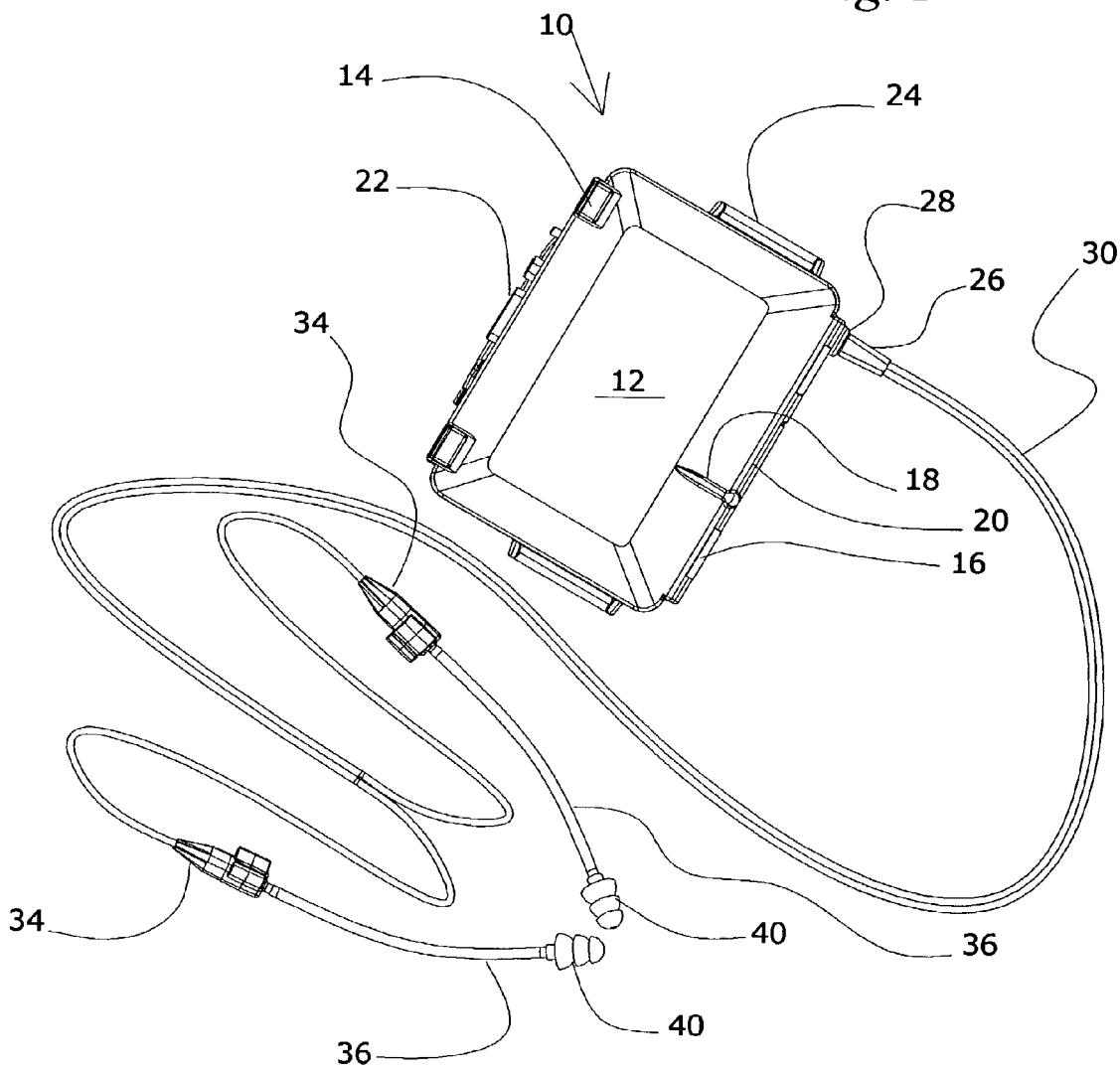
FIG. 1 is a plan view of a preferred embodiment of the invention illustrating a headphone-audio player combination.
Figure 2:
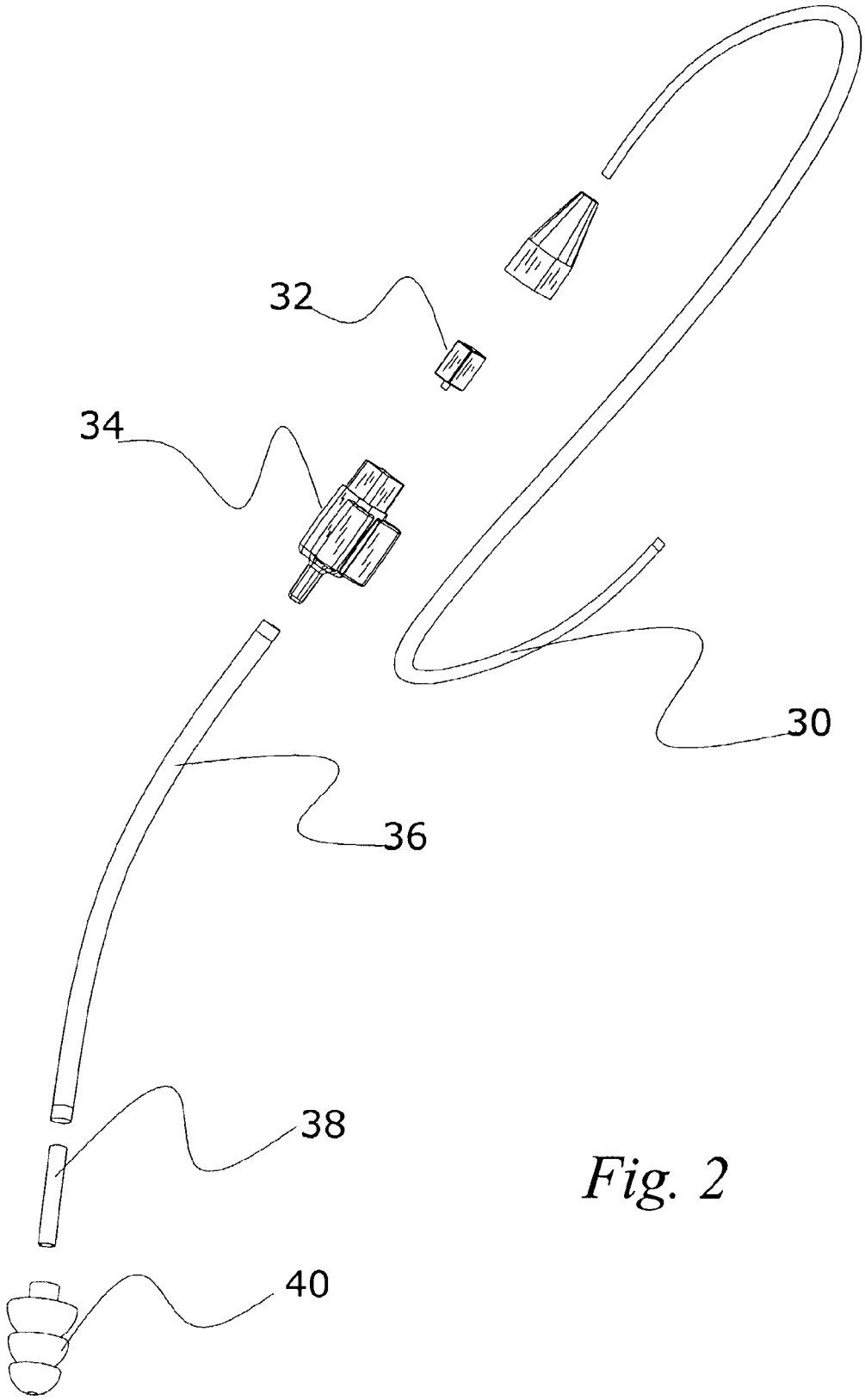
FIG. 2 is a plan view of a preferred embodiment of headphone according to the present invention.

Referring now to the drawings of a preferred embodiment wherein like reference numerals designate identical or corresponding parts throughout the several views, there is illustrated generally at 10 a submersible personal stereo system comprised of an electrical signal generator 12 in the form of, for example, an audio player such as a cassette player, a compact disk player, an MP3 player, or a signal receiver, or the like. Generator 12 is sealed within a watertight case the lid to which is secured in place against a deformable gasket (not shown) by recessed latches, a typical one of which is shown at 14, and hinges, a typical one of which is shown at 16. A torsion spring, an arm of which is shown at 18, and the torsion leg of which is shown at 20, includes an anchor arm (not shown), acts to hold the lid open when the latches 14 are disengaged. An unlatched condition is immediately apparent because the lid is standing open. This tends to prevent accidental submersion of the unit with the lid open. The operation controls for the unit are indicated at 22. The operating controls are all of the direct push-to-operate type, and are covered by a flexible waterproof membrane. The membrane is sealed to the rest of the case. Attachment handles, a typical one of which appears at 24, serve to mount the unit by way of a strap or belt (not shown) to a user.

A headphone unit is electrically connected to the electrical signal generator 12 through a waterproof plug 26 that is received in a gasketed waterproof socket 28. An insulated electrical line 30 carries electrical signals from signal generator 12 to a bipolar armature transducer, indicated diagrammatically at 32. Transducer 32 is electrically connected to line 30 to receive signals from unit 12. The electrical connection between line 30 and transducer 32 is made within a waterproof electrical housing 34. Transducer 32 is received within a waterproof acoustic housing, which is indicated diagrammatically at 34. Transducer 32 converts the electrical signal received from unit 12 into an audible signal, which can be perceived by the human ear. The bipolar armature transducer 32, as is well known in the art, has a diaphragm (not shown). The diaphragm vibrates so as to generate an audible signal.

Acoustic housing 34 provides a resonator chamber wherein the audible signal originates. The audible signal travels from the waterproof acoustic housing 34 to a human eardrum (not shown) through a flexible small internal diameter tube 36. The distal end of tube 36 is connected to housing 34, and the proximal end of tube 36 is connected through a short mounting stub 38 to a conventional barbed ear plug 40. The tip of ear plug 40 is open so as to permit the passage of sound through a continuous body of air between the eardrum and the diaphragm of the transducer.

It is very destructive of the functionality of the headphones to have water travel down inside the tube 36 to the transducer. The water blocks sound and ultimately corrodes the transducer. The most serious risk of water intrusion occurs when the headphones are accidentally dislodged from the ear while several feet under water. The configuration and characteristics of the acoustic system or circuit must be such that the passage of water down the inside of tube 36 to the transducer is blocked. The structure of the acoustic circuit provides a blind-ended gas column (i.e.; air). The only way water can enter the system is by compressing the gas column. This acoustic circuit is watertight except at the tip of the ear plugs. The acoustic circuit includes the volume of air in the tubing and the volume of air in the transducer. All transducers have some volume of air within them. The volume of the air within the tube must equal or exceed the volume of the air within the transducer. At 33 feet under water, the pressure is two atmospheres, which would compress the air in the acoustic circuit by 50 percent. Preferably the volume of the tubing is at least about 1.2 times the volume of the transducer between the diaphragm and the tube. For acoustic quality considerations the internal diameter of the tubing should be between about 0.040 inches and 0.175 inches.

The transducer must be chosen so that it is operable with only the small volume of air in it that is dictated by the necessity of using gas pressure to exclude water from reaching the diaphragm. Transducers that enjoy such characteristics include, for example, piezoelectric and bipolar armature transducers. Dynamic speakers of the type disclosed, for example in Silverman U.S. Pat. No. 4,683,587 are generally inoperable under such conditions.

In circumstances where the headphones are removed in a wet environment, the characteristics of the material from which the tubes are constructed plays a significant role in preventing water from entering the tubing. The tubing is importantly made of a material having particular internal diameter and wetting characteristics which maintains the function of transmitting sound while not admitting water. Thus, the wetting characteristics of the tubing with respect to water, chlorinated water and sea water is of critical importance in the present invention. Generally, swimming waters such as mentioned above have roughly equivalent wetting characteristics for these purposes. A tubing suitable for use in the present invention will be essentially as non-wettable as possible with respect to these waters. The proximal end of the tubing is substantially hydrophobic. As is well known by those skilled in the art, the property of wetting is usually measured by determining the angle of incidence of water-to-air boundary lying on the surface of the material being considered. This is discussed at length in Silverman U.S. Pat. No. 4,683,587, which discussion is hereby incorporated herein by reference. Examples of suitable plastic materials for use as tubing with the present invention include polyethylene, polypropylene, diene polymers, polystyrene, acrylonitrile-butadiene-styrene terpolymers, nylon, polyesters, polyurethanes, and the like. It is important that the tubing exhibit capillary depression. By this is meant that for tubings of the preferred materials having high contact angles, it will be impossible for a drop of such waters to enter them if they are sufficiently small.

What have been described are preferred embodiments in which modifications and changes may be made without departing from the spirit and scope of the accompanying claims. Clearly, many modifications and variations of the present invention are possible in light of the above teachings. It is therefore to be understood that, within the scope of the appended claims, the invention may be practiced otherwise than as specifically described.

What is claimed is:

1. A headphone, said headphone being watertight and comprising a hollow tube having a distal end and a proximal end, said proximal end being open and substantially hydrophobic, a plug surroundingly associated with said proximal end, said plug being adapted to sealingly engaging an outer ear canal adjacent to an eardrum in a substantially water tight fit, an electro-acoustic transducer mounted at approximately said distal end and enclosed therewith by a housing, said transducer adapted to being connected to a source of electric signals, said transducer including a diaphragm element, said diaphragm element being adapted to generating acoustic waves responsive to said electric signals, said transducer housing and enclosing a first volume of air, said hollow tube enclosing a second volume of air, said second volume being at least as great as said first volume, said transducer being acoustically associated with only one said hollow tube.

2. A headphone of claim 1 wherein said headphone comprises two transducers and two hollow tubes, each of said transducers being acoustically isolated from all but one of said hollow tubes.

3. A headphone of claim 1 wherein said second volume is at least 1.2 times greater than said first volume.

4. A headphone of claim 1 wherein said electro-acoustic transducer is a piezoelectric transducer.

5. A headphone of claim 1 wherein said electro-acoustic transducer is a bipolar armature transducer.

* * * * *